United States Patent [19]

Lepert

[11] Patent Number: 4,712,984

[45] Date of Patent: Dec. 15, 1987

[54] PROCESS AND APPARATUS FOR CIRCULATING FLUIDS BY PUMPING

[75] Inventor: Claude Lepert, Annecy le Vieux, France

[73] Assignee: Etablissements Pompes Guinard, Courbevoie, France

[21] Appl. No.: 10,686

[22] Filed: Feb. 4, 1987

[30] Foreign Application Priority Data

Feb. 10, 1986 [FR] France ..... 86 01763

[51] Int. Cl.[4] ..... F04B 17/00

[52] U.S. Cl. ..... 417/391; 417/406

[58] Field of Search ..... 417/407, 406, 408, 409, 417/391, 379, 376; 60/39.52, 39.41

[56] References Cited

U.S. PATENT DOCUMENTS

| | | | |
|---|---|---|---|
| 975,526 | 11/1910 | Hood | 417/376 |
| 1,842,961 | 1/1932 | Coppus | 417/376 X |
| 3,194,026 | 7/1965 | Fleur | 417/408 |
| 3,420,434 | 1/1969 | Swearingen | 417/407 |
| 4,271,664 | 6/1981 | Earnest | 60/39.52 X |
| 4,426,842 | 1/1984 | Collet | 60/39.52 X |

FOREIGN PATENT DOCUMENTS

| | | | |
|---|---|---|---|
| 1103687 | 3/1961 | Fed. Rep. of Germany | 60/39.52 |
| 2554608 | 8/1976 | Fed. Rep. of Germany | . |
| 2470878 | 6/1981 | France | . |

*Primary Examiner*—Leonard E. Smith

*Attorney, Agent, or Firm*—Pearne, Gordon, McCoy & Granger

[57] ABSTRACT

Process for pumping fluid composed of a liquid phase and of a gaseous phase, which involves conveying liquid under pressure to the inlet of the turbine of a turbomachine comprising a pump and a turbine, mixing some of the liquid coming from the turbine with the fluid, and sucking the mixture through the inlet of the pump so as to reduce the gas content of the fluid and allow it to be conveyed by the pump.

13 Claims, 1 Drawing Figure

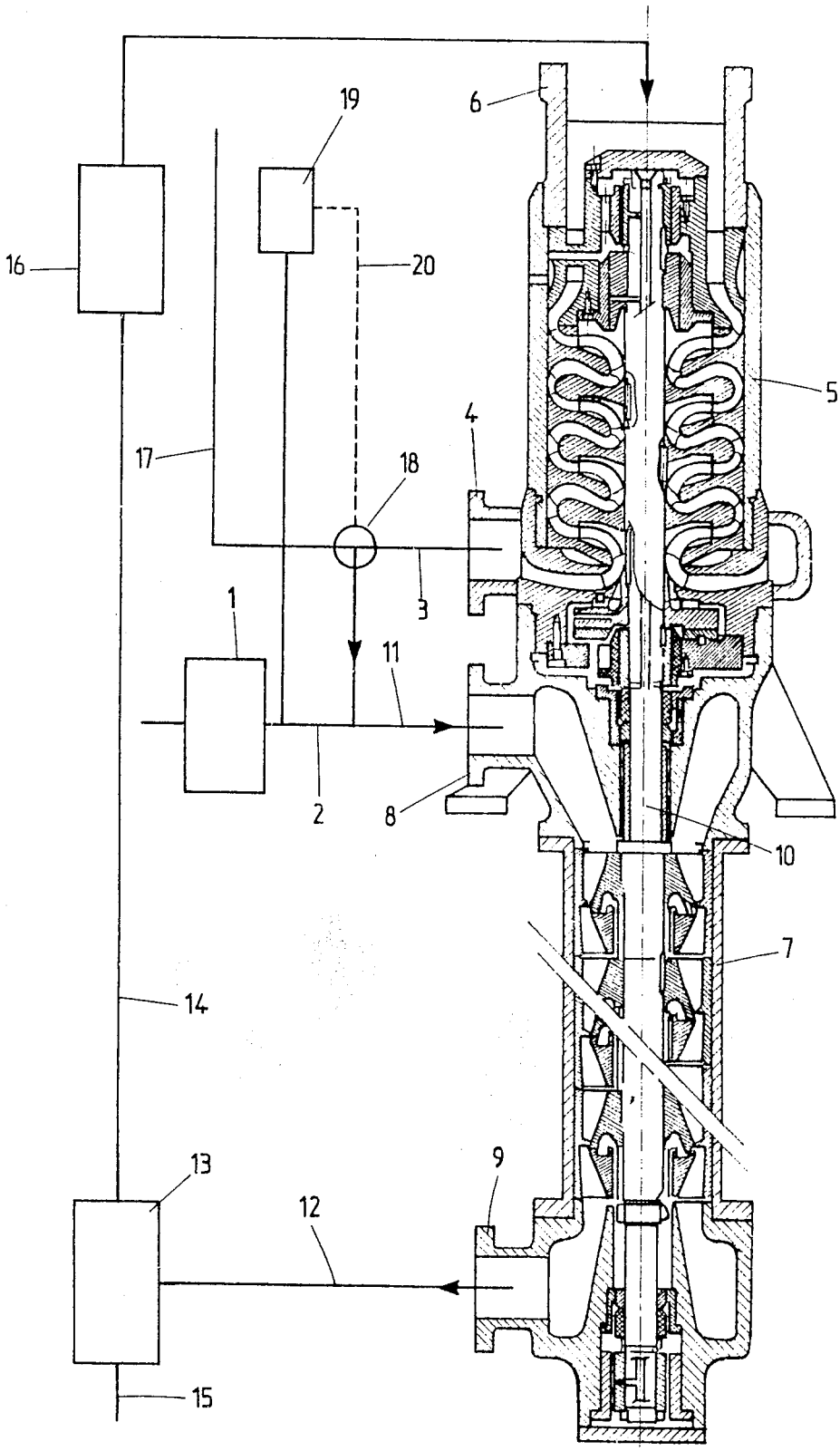
19
6
16
20
5
4
17
18
3
1
11
2
8
10
7
14
13
9
12
15

PROCESS AND APPARATUS FOR CIRCULATING FLUIDS BY PUMPING

The present invention relates to processes and apparatuses for circulating fluids by pumping. The invention is aimed more particularly at processes and apparatuses for pumping fluids composed of at least one liquid phase and of at least one gaseous phase, the latter making pumping very difficult.

French Pat. No. 2,470,878 already describes a process for pumping fluid composed of a liquid phase and of a gaseous phase, which involves conveying liquid under pressure to the inlet of the turbine of a turbo-machine comprising a pump having an inlet and an outlet and a turbine which has an inlet and an outlet separate from those of the pump and which is keyed on the same shaft as the pump. All the liquid coming from the turbine is mixed with the fluid to be conveyed through the pump in order to obtain an ejection effect. To obtain this ejection effect, it is therefore essential that the energy of the liquid at the outlet of the turbine should still be substantial and, in particular, that the kinetic energy of the liquid leaving the turbine should be sufficient to suck the fluids from the well towards the pump. The ejector formed in this way exerts an initial pressure increase on the fluid in the well. It is therefore advisable that the liquid should leave the turbine likewise at a certain pressure. As a result of this, the energy of the liquid is not utilized as effectively as possible in the turbine, since some of this energy is necessary for an operation downstream. Moreover, although it is advantageous to mix all the liquid with the fluid in order to give the fluid the necessary speed to convey it into the pump, the disadvantage of this is that the pump has to be designed for a high flow and therefore requires considerable power.

The invention overcomes these disadvantages by means of a process for pumping fluid composed of a liquid phase and of a gaseous phase, which makes it possible for the turbine to operate under the best possible conditions and which only requires a power as low as possible for the pump to operate.

The process according to the invention involves mixing with the fluid only some of the liquid, representing the proportion necessary to reduce the gas content of the mixture to a value below that from which the mixture can be pumped into the pump, and transferring or returning the rest of the liquid to the inlet of the turbine.

According to the invention, there is no longer any attempt to make the liquid perform any ejection function. The liquid serves as a fluid feeding the turbine of the turbo-machine, supplying the energy necessary for the operation of the pump. Some of the liquid also serves to reduce the gas content of the fluid and thus make it acceptable so that the mixture of fluid and liquid can be pumped. Since as little expanded harnessed (which passed through the turbine) liquid as possible enters the pump, the latter also requires as little power as possible.

Advantageously, the liquid is expanded completely in the turbine, and in addition it is prevented from retaining any kinetic energy. The turbine thus operates under the best possible conditions.

Preferably, the gas content of the fluid is detected and the proportion of liquid mixed with the fluid is varied as a function of the gas content detected.

In general, the ratio between the quantity of harnessed liquid contained in the mixture and the quantity which is returned can vary between 0 and 0.5.

Advantageously, the flow of harnessed liquid mixed with the fluid, representing 0 to 2 parts by volume per 1 part of fluid, is equal to the flow of liquid, separated in the form of a first stream and representing 25% to 65% of the volume of the mixture which leaves the pump.

The invention is also aimed at a pumping apparatus comprising a fluid source and a turbo-machine comprising a pump having an inlet and an outlet and a turbine which is keyed on the same shaft as the pump and which has an inlet and an outlet, the outlet of the turbine opening into a pipe putting the source in communication with the pump. The apparatus is characterized by a transfer or return pipe communicating with the outlet of the turbine and by a device making it possible to adjust the quantities of liquid coming from the outlet of the turbine, which enter respectively the transfer or return pipe and the pipe putting the source into communication with the pump.

According to an advantageous alternative form, the apparatus has a detector for the gas content of the fluid, and the device making it possible to adjust the quantities of liquid is controlled by the detector via a control line as a function of the contents detected.

Advantageously, the apparatus possesses a unit separating a fluid consisting of a gaseous phase and of a liquid phase into a first stream richer in the liquid phase than the fluid and into a second stream, the unit being equipped with an inlet communicating with the outlet of the pump and with two outlets, of which the one for the first stream communicates with the inlet of the turbine.

Preferably, the pump is such that the curve representing the value of the curvature along the outline of the profile of a blade as a function of the absence of a curve along this outline has a slope of a value increasing progressively from the leading edge of the blade towards its trailing edge, as described in French Pat. No. 7,536,774 which is enclosed herewith by way of reference; the pump advantageously has the other characteristics defined in this patent, but can have any other hydraulic characteristics designed specially for two-phase flows.

The single figure of the accompanying drawing illustrates the invention.

Fluid composed of a liquid phase and of a gaseous phase comes from a source 1 via a pipe 2. A pipe 3 leading from the outlet 4 of a turbine 5 of a turbo-machine opens into the pipe 2. This machine essentially comprises the turbine having the outlet 4 and an inlet 6 and a pump 7 having an inlet 8 and an outlet 9 and keyed on the same shaft 10 as the turbine 5. A detailed description of this turbo-machine will be found in French Pat. No. 7,823,250.

Mounted on the pipe 3 is a device 18 making it possible to adjust the quantities of liquid flowing respectively towards the pipe 11 and towards a return pipe 17. The device 18 is controlled via a line 20 by a detector 19 which detects the gas contents of the fluid entering the pipe 2.

The mixture of fluid and liquid is conveyed, at a pressure of between 10 and 100 bars, via a pipe 11 to the inlet 8 of the pump 7. The latter delivers it, via the outlet 9 and via a pipe 12, to a separation unit 13, where the mixture, if appropriate after decanting or centrifuging the solids, is separated into a first stream flowing via the pipe 14, with compression in a pump 16 under a pressure of between 20 and 250 bars, to the inlet 6 of the turbine 5 and into a second stream discharged via a pipe 15.

The gas content of the first stream is less than 5% by volume.

The following example illustrates the invention.

60 $m^3/h$ of oil free of gas are conveyed into the turbine at a pressure of 100 bars. The turbo-machine rotates at 6000 revolutions per minute. The expansion head in the turbine is 800 m. The expanded oil is mixed at the rate of 60 $m^3/h$ with a crude having a GLR of 10. The GLR represents the ratio of the volume of gas to the volume of liquid. The pressure head of the pump is 150 m. Despite its high GLR, the crude can thus be pumped without difficulty.

I claim:

1. A process for pumping a fluid composed of a liquid phase and a gaseous phase using a turbo-machine comprising a pump having an inlet and an outlet and a turbine having an inlet and an outlet separate from the pump inlet and outlet, said pump and turbine being operably connected to a common shaft so that the turbine drives the pump, comprising the steps of providing a flow of fluid from a source thereof to said pump inlet to provide a portion of a fluid mixture input to said pump, separating a portion of the output of said pump to provide a portion of a turbine driving fluid, pressurizing said turbine driving fluid and flowing it into the turbine inlet to drive said turbine and pump, withdrawing spent turbine driving fluid from said turbine outlet, mixing a portion of the spent turbine driving fluid with said separated portion of the output of said pump to provide said turbine driving fluid, and mixing the remainder of said spent turbine driving fluid with said flow of fluid from said source of fluid to provide said fluid mixture input to said pump, said flow of fluid from said source thereof having a liquid phase and a gaseous phase of a proportion which exceeds the pumping capability of said pump, but which is reduced by mixture with a sufficient amount of spent turbine driving fluid to allow pumping of the fluid mixture by said pump.

2. Pumping apparatus comprising a liquid source and a turbo-machine comprising a pump having an inlet and an outlet and a turbine which is keyed on the same shaft as the pump and which has an inlet and an outlet, the outlet of the turbine opening into a pipe putting the source in communication with the pump, comprising a transfer or return pipe communicating with the outlet of the turbine and comprising a device making it possible to adjust the quantities of liquid coming from the outlet of the turbine, which enter respectively the transfer or return pipe and the pipe putting the source into communication with the pump.

3. Apparatus according to claim 1 which possesses a detector which detects the gas content of the fluid in the pipe putting the source in communication with the pump and which controls the device as a function of this content.

4. Apparatus according to claim 3, comprising a unit separating a fluid consisting of a gaseous phase and of a liquid phase into a first stream richer in the liquid phase than the fluid and into a second stream, the unit being equipped with an inlet communicating with the outlet of the pump and with two outlets, of which the one for the first stream communicates with the inlet of the turbine.

5. Apparatus according to claim 4, which posesses a detector which detects the gas content of the fluid in the pipe putting the source in communication with the pump and which controls the device as a function of this content.

6. Process for pumping fluid composed of a liquid phase and of a gaseous phase, comprising conveying liquid under pressure to the inlet of the turbine of a turbo-machine comprising a pump having an inlet and an outlet and a turbine which has an inlet and an outlet separate from those of the pump and which is keyed on the same shaft as the pump, mixing the fluid with liquid coming from the turbine in order to obtain a mixture, and sucking the mixture through the inlet of the pump, wherein only some of the liquid, representing the proportion necessary for reducing the gas content of the mixture to a value below that from which the mixture can be pumped into the pump, is mixed with the fluid, and transferring or returning the rest of the harnessed liquid.

7. Process according to claim 6, comprising expanding the liquid in the turbine almost completely, and preventing it from retaining any substantial kinetic energy.

8. Process according to claim 6, comprising detecting the gas content of the fluid and varying the proportion of the liquid mixed with the fluid as a function of the gas content which is detected.

9. Process according to claim 6, wherein the ratio between the quantity of liquid contained in the mixture and that which is returned varies between 0 and 0.5.

10. Process according to claim 6, comprising mixing 0 to 2 parts by volume of the expanded liquid with 1 part of the fluid.

11. Process according to claim 6, comprising separating the fluid leaving the pump into a first liquid stream having a gas content less than 10% by volume and into a second stream, compressing the first stream and conveying it as liquid to the inlet of the turbine.

12. Process according to claim 11, wherein the first stream represents 25 to 65% of the flow of fluid leaving the pump.

13. Process according to claim 11, wherein the first stream is conveyed to the turbine.

* * * * *

UNITED STATES PATENT AND TRADEMARK OFFICE

CERTIFICATE OF CORRECTION

PATENT NO. : 4,712,984

DATED : December 15, 1987

INVENTOR(S) : Claude Lepert

It is certified that error appears in the above-identified patent and that said Letters Patent is hereby corrected as shown below:

Column 3, (claim 3) line 1, delete "claim 1" and insert --claim 2--.

Column 4, (claim 4) line 1, delete "claim 3" and insert --claim 2--.

Signed and Sealed this

Thirty-first Day of May, 1988

*Attest:*

*Attesting Officer*

DONALD J. QUIGG

*Commissioner of Patents and Trademarks*